United States Patent [19]

McIntyre

[11] Patent Number: 4,834,847

[45] Date of Patent: May 30, 1989

[54] ELECTROCHEMICAL CELL FOR THE ELECTROLYSIS OF AN ALKALI METAL HALIDE AND THE PRODUCTION OF A HALOGENATED HYDROCARBON

[75] Inventor: John M. McIntyre, Lake Jackson, Tex.

[73] Assignee: The Dow Chemical Company, Midland, Mich.

[21] Appl. No.: 36,152

[22] Filed: Apr. 3, 1987

Related U.S. Application Data

[63] Continuation of Ser. No. 830,046, Feb. 18, 1986, abandoned.

[51] Int. Cl.[4] ..... C25B 3/06

[52] U.S. Cl. ..... 204/81; 204/263; 204/283; 204/284; 204/294; 204/296

[58] Field of Search ..... 204/252, 263, 283, 294, 204/296, 81, 284

[56] References Cited

U.S. PATENT DOCUMENTS

| | | | |
|---|---|---|---|
| 1,253,615 | 1/1918 | McElroy | 204/80 |
| 1,253,616 | 1/1918 | McElroy | 204/80 |
| 1,253,617 | 1/1918 | McElroy | 204/80 |
| 1,264,536 | 4/1918 | McElroy | 204/80 |
| 1,295,339 | 2/1919 | McElroy | 204/80 |
| 1,308,797 | 6/1919 | McElroy | 204/80 |
| 3,288,692 | 11/1966 | Leduc | 204/80 |
| 3,558,453 | 2/1968 | Mayell | 204/81 |
| 4,031,000 | 6/1977 | Nakamura | 204/252 |
| 4,119,507 | 10/1978 | Simmrock | 204/80 |
| 4,334,967 | 6/1982 | Tedoradze | 204/81 |
| 4,472,252 | 9/1984 | Delue | 204/59 R |
| 4,722,773 | 2/1988 | Plowman | 204/252 |

OTHER PUBLICATIONS

Kalinin, *Journal of Applied Chemistry,* (USSR), 19, 1045, (1946).

*Primary Examiner*—John F. Niebling
*Assistant Examiner*—Ben C. Hsing
*Attorney, Agent, or Firm*—Andrew E. Pierce

[57] ABSTRACT

An electrochemical cell and process for the electrolysis of an aqueous solution of an alkali metal halide and the production of a halogenated hydrocarbon comprising an electrolytic cell having a gas depolarized anode and a cathode which can be a dimensionally stable or a gas depolarized cathode wherein the production of an aqueous solution of an alkali metal hydroxide and a halogenated hydrocarbon are accompanied by significantly reduced voltage requirements in the cell.

4 Claims, 1 Drawing Sheet

ELECTROCHEMICAL CELL FOR THE ELECTROLYSIS OF AN ALKALI METAL HALIDE AND THE PRODUCTION OF A HALOGENATED HYDROCARBON

This is a continuation of co-pending application Ser. No. 830,046 filed on Feb. 18, 1986 now abandoned.

BACKGROUND OF THE INVENTION (1) Field of the Invention

The invention relates to an electrochemical cell for the production of halogenated hydrocarbons and an aqueous solution of an alkali metal hydroxide. In electrochemical cells the free energy of reaction is reduced by the addition of an unsaturated hydrocarbon which results in a reduction in energy consumption while the main product of value is produced.

(2) Description of the Prior Art

Very little work has been reported on halogenation of hydrocarbons in electrochemical systems. Langer et al in the *Journal of The Electrochemical Society,* 117, No. 4 510 (1970) disclose the electrochemical chlorination of an olefin utilizing an aqueous potassium chloride electrolyte; the reaction taking place on catalytic electrodes. Chlorine is reduced at the cathode to form chloride ions while electrons are supplied by the external circuit. At the anode, the olefin reacts with the chloride ions which are transported from the cathode through the electrolyte to the anode where the chlorinated olefin product is formed with a yield of electrons to the external circuit. At low anode potential (low current), the current yield of dichloroethane (1,2-dichloroethane) was about 90 percent with 10 percent of the current resulting in the formation of chlorohydrin. A yield of dichloropropane utilizing propylene as a feed gas was reported at a current yield of 18 percent.

The early U.S. Pats. of McElroy, U.S. Pat. Nos. 1,253,615; 1,253,616; and 1,253,617; U.S. Pat. No. 1,264,536; U.S. Pat. No. 1,295,339; and U.S. Pat. No. 1,308,797 disclose an electrochemical method for the manufacture of alkali and by products chloroethanol and dichloroethane. An aqueous solution of potassium chloride or sodium chloride is electrolized by McElroy by applying a potential of 3.5 to 5 volts across wire gauze electrodes while the anode is contacted with an olefin. The olefin is chlorinated at the anode, the chlorination reaction serving to depolarize the anode thus resulting in an energy saving over a simple electrolysis process. Platinum black was found to catalyze the chlorination process and lower temperatures were found to favor the formation of 1,2-dichloroethane.

Bhattacharyya et al in the *J. Sci. Ind. Res.* (India), 11.B 371 (1952) report the results of the use of porous carbon anodes and copper cathodes in a 10 percent sodium chloride electrolyte for the production of 2-chlorethanol with a 5 percent ethylene glycol byproduct. At 90 degrees centigrade the current efficiency for the production of 2-chloroethanol was 1 percent while the current efficiency for the production of ethylene glycol was 17 percent. The current efficiency (yield) at 1 degree centigrade and 22.5 ma/cm$^2$ was reported as 84 percent for 2-chloroethyanol and 5 percent for ethylene glycol.

Kalinin et al in the *Journal of Applied Chemistry* (USSR), 19, 1045 (1946) disclose the aqueous electrochemical chlorination of ethylene utilizing aqueous sodium chloride as an electrolyte and graphite electrodes. A yield of 1,2-dichloroethane of 44 percent utilizing a five normal solution of sodium chloride is reported.

Simmrock et al in U.S. Pat. No. 4,119,507 disclose an electrochemical system for reacting a chlorine-containing anolyte to form an olefin chlorohydrin which is subsequently reacted to form an oxirane. Low yields of 1,2-dichloropropane are disclosed in the examples; the yields ranging from 7 to 22 percent at a current efficiency of about 99 percent.

In U.S. Pat. No. 4,334,967, a method for preparing 1,2-dichloroethane is disclosed comprising the electrolysis of a 12 to 36 percent aqueous solution of hydrochloric acid at a temperature of 45 to 70 degrees centigrade; ethylene being simultaneously supplied into the anodic space of an electrolytic cell; the electrolyte being previously treated with a metal of the group of iron or compound of a metal of said group.

The major proportion of the vast amounts of energy consumed in the world today is obtained from chemical reactions associated with the thermocombustion of fuels. Production of electrical energy by thermocombustion is restricted by Carnot cycle factors which limit conversion efficiencies to about 40 percent at a central power generation site. The inherently greater efficiency of direct electrical energy generation from electrochemical reaction in fuel cells was recognized around the turn of the century but did not deter the proliferation of mechanical devices as the principal means for electrical energy generation. With the end of the plentiful supply of liquid fossil fuels in sight together with the increase of prices of such fuels subsequent to 1973, fuel cell electrical energy generation is being actively examined.

Many chemical reactions other than combustion release large amounts of energy which are regularly wasted as heat during industrial chemical processing. One means of recovering this energy is the performance of certain reactions at depolarized electrodes. The depolarization process has been defined as one in which favorable thermodynamic factors drive an electrochemical cell in which reactions take place to give a desired chemical product at a reduced electrical energy outlay. The depolarization mode is characterized by reduced electric energy consumption while the main product of value is produced.

SUMMARY OF THE INVENTION

An electrochemical electrolytic cell is disclosed in which a conventional dimensionally stable anode utilized in an electrolytic cell for the electrolysis of an alkali metal halide to produce a halogen and an alkali metal hydroxide is replaced by a gas diffusion anode wherein the anode is depolarized with an unsaturated hydrocarbon. The cell is used to produce a halogenated hydrocarbon as well as an aqueous solution of an alkali metal hydroxide while the operating voltage requirements for the cell are significantly reduced. Suitable gas depolarized anodes are disclosed for use in the electrochemical cell of the invention.

DESCRIPTION OF THE PREFERRED EMBODIMENTS

Figure 1:
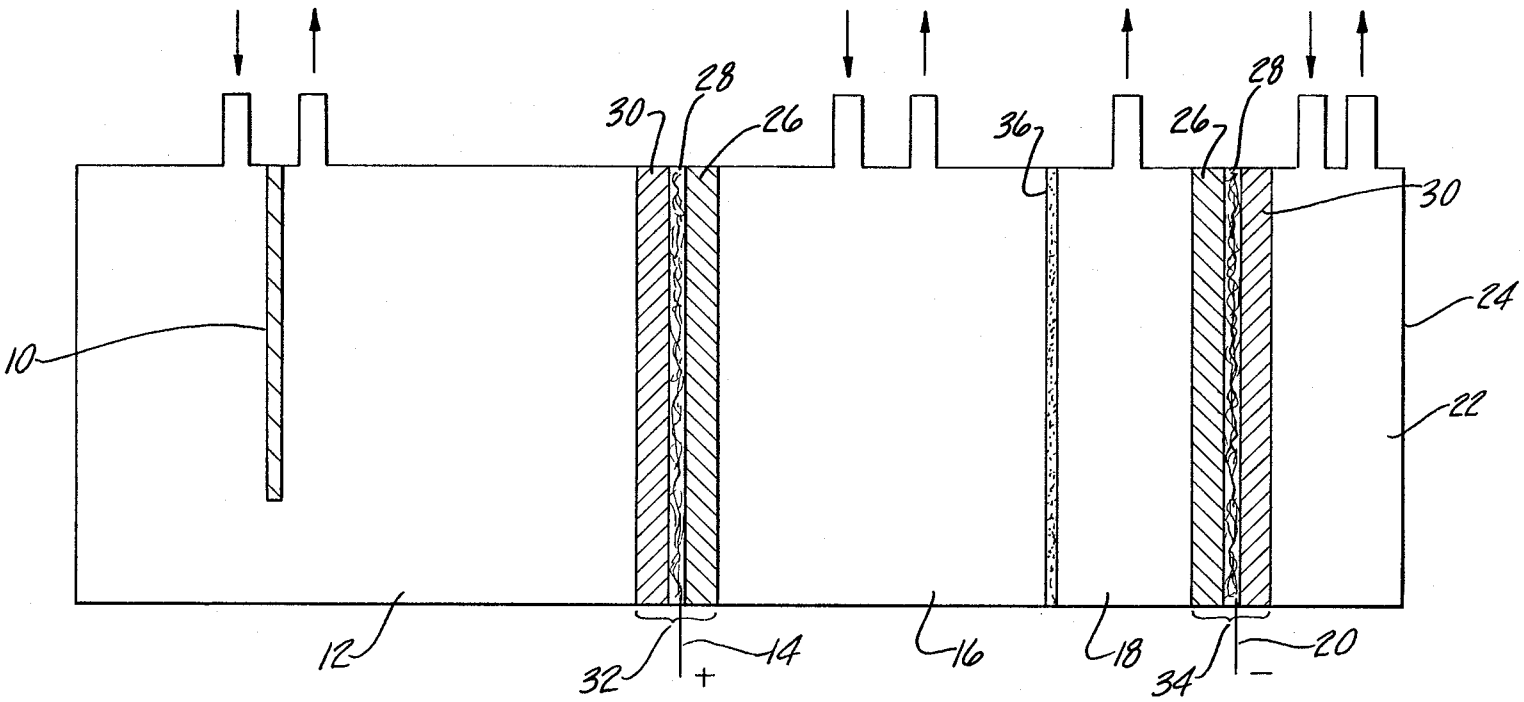
FIG. 1 is a schematic illustration of one embodiment of an electrochemical cell made in accordance with the present invention having a depolarized electrode.

The following description illustrates the manner in which the principles of the present invention are applied but is not to be construed as in any sense limiting the scope of the invention.

In the following description of the drawing, the same or similar structures are referred to by the same numbers.

More specifically, FIG. 1 illustrates schematically one embodiment of an electrochemical cell made according to the present invention in which the electrolysis cell comprises a cell having walls 24, an anodic electrode 32, a cathodic electrode 34 and may include a baffle or separator 10 in compartment 12 in which an unsaturated hydrocarbon is recirculated. Electrolyte solution compartments 16 and 18 are separated by a membrane or diaphragm 36 which can be a anion permeable permselective membrane or an electrolyte permeable diaphragm. Electrical lead 14 is attached to the anodic electrode 32 and an electrical lead 20 is attached to the cathodic electrode 34.

The anodic electrode 32 is a porous gas diffusion anode which can be homogeneous or heterogeneous. Preferably the cathodic electrode 34 is also a porous gas diffusion electrode but the cathode can also be a dimensionally stable cathode. The anode and the cathode can be in the form of a porous planar sheet. The sheet electrode can be heterogeneous or homogeneous and can be a monolayer or plural layer construction. The electrodes can also be hollow electrodes of heterogeneous or homogeneous construction and can contain at least one but preferably contains plural layers. The electrodes can also be those characterized as self-draining as disclosed by McIntyre et al. in U.S. Pat. No. 4,406,758. The anode and cathode can comprise a porous hydrophobic layer 30, a porous hydrophilic, electrochemically active layer 26 and a current collector 28 separating the hydrophobic layer 30 from the hydrophilic layer 26 and in electrical contact with the porous hydrophilic layer 26. The hydrophobic material forming the hydrophobic layer 30 is preferably a porous polytetrafluoroethylene. The porous hydrophilic layer can be formed from a composition of a hydrophobic material and a particulate carbon wherein the hydrophobic material is utilized to substantially bond the particulate carbon material. Preferably the hydrophobic material binder is a polytetrafluoroethylene polymer.

The current collector 28 forms with the anode hydrophobic and hydrophilic layers an electrode assembly. Said current collector can be a metal mesh fabric such as a 20×20×0.010 inch preferably silver-plated nickel wire mesh. Preferably wire meshes are used having less than 0.015 inch dimension wire strands and greater than 10 strands in each direction per inch. The wire mesh current collector can be prepared from a metal selected from the group consisting of stainless steel, nickel, platinum group metals, valve metals, and mixtures thereof. Preferably the metal mesh is prepared from a metal selected from the group consisting of silver or silver-coated nickel, or silver-coated steel and silver-coated valve metals.

The hydrophilic layer 26 of anode 32 and the preferred form of cathode 34 are characterized as having a high degree of porosity and a large specific-surface area. The specific-surface area is preferably between about 20 and about 30 square meters per gram. Hydrophilic layer 26 is preferably composed of a major amount, about 80 to 90 percent by weight, of a particulate, electrically conductive material such as carbon and a minor amount of about 10 to 20 percent by weight of a polytetrafluoroethylene binder. The hydrophilic layer 26 is preferably fabricated by forming a mixture of an equal or major amount of said hydrophilic material and an equal or minor amount of said hydrophobic material specifically about 80 percent of a particulate, conductive carbon, about 10 percent of granular polytetrafluoroethylene together with about 10 percent of a pore-forming ingredient, i.e., granular sodium chloride, all by weight. The electrode sheet is obtained after calendering, sintering, water leaching, and drying the mixture utilizing techniques which are well known for producing a porous sheet of polytetrafluoroethylene bonded carbon. The composition of the dried layer 26 produced in this manner would be about 90 percent electrically conductive, particulate carbon and about 10 percent polytetrafluoroethylene by weight. A porous, homogeneous, hydrophobic polymer layer is similarly produced using a hydrophobic polymer such as polytetrafluoroethylene in granular form in combination with a pore-forming ingredient which is thereafter removed to render the layer porous. The pore-forming ingredient can be a particulate inorganic solid or a polymeric pore-forming ingredient. It can be a water-soluble salt such as an alkali metal salt selected from the group consisting of sodium chloride, potassium chloride, and mixtures thereof. It can be a substantially water-insoluble solid such as an alkaline earth metal carbonate.

The electrically conductive carbon utilized in the formation of the hydrophilic layer 26 can be any electrically conductive, hydrophilic carbon. For instance an acetylene black having a small particle size which is electrically conductive can be used. Certain other carbon blacks such as furnace blacks are also electrically conductive and can be used. Graphite is also useful. The carbon can be porous or non-porous. Generally carbon blacks having a particle size ranging from about 0.01 to about 0.05 microns, and more usually within the range of about 0.01 to about 0.03 microns are suitable.

While polytetrafluoroethylene is the most preferred polymer for use in the preparation of the electrodes of the invention, if desired, other polymers can be used instead. Preferred hydrophobic polymers are the thermoplastic halocarbon polymers selected from the group consisting of at least one of polymers of tetrafluoroethylene, fluorinated ethylene propylene, copolymers thereof having the moieties $$(-CX_1X_2-CX_3CX_4-),$$

$$(-CY_1Y_2-CY_3Y_4-),$$

and homopolymers having the moieties $$(-CY_1Y_2-CY_3F-)$$

wherein $X_1$, $X_2$, $X_3$, $X_4$, $Y_1$, $Y_2$, $Y_3$, and $Y_4$ are selected from the group consisting of fluorine, chlorine, and hydrogen, at least one of said X and Y being fluorine. Preferably the halocarbon polymer is a fluorocarbon polymer selected from the group consisting of at least one of said copolymers having an ethylene moiety and a fluorocarbon moiety chosen from the group consisting of $(-CFH-CH_2-)$, $(-CF_2-CH_2)$, $(-CF_2-CFH-)$, $(-CF_2-CF_2-)$, and $(-CH_2-CClF-)$.

Suitable hydrophobic polymers can generally include any polymer having a low surface energy which will remain stable under fuel cell or chlor-alkali electrolysis cell operating conditions. Such polymers include polymers of various halogen-substituted hydrocarbon monomers, particularly fluorine-substituted olefinic monomers. Halogen-containing polymers that can be employed include polymers of fluorocarbons and substitited fluorocarbons wherein one or more fluorine atoms are replaced by hydrogen, chlorine, or bromine. Alternative halocarbon polymers include polytrifluoroethylene, polyvinylfluoride, polyvinylidene fluoride, polytrifluorochloroethylene, and copolymers of different fluorocarbon monomers such as copolymers of tetrafluoroethylene and hexafluoropropylene.

In addition to the halocarbon polymers, various other hydrophobic polymers which can be used include hydrocarbon polymers having a molecular weight of 50,000 to 1,000,000 ore more, and a free surface energy close to or below that of polyethylene. Representative polymers include polymers and copolymers of ethylene, propylene, 3-ethyl-1-butene, 4-methyl-1-pentene, and 4,4-dimethyl-1-pentene. Silicone polymers are also suitable as hydrophobic polymers for use in the preparation of the electrodes of the invention.

Use of the preferred gas depolarized cathode 34 permits the depolarization of the cathode by an oxygen-containing gas supplied to gas compartment 22. Alternatively, in another embodiment of the electrochemical cell of the invention, a foraminous dimensionally stable cathode can be utilized. The dimensionally stable cathode can be made of a metal which will resist the conditions to which it is exposed in the electrochemical cell of the invention. Such metals as titanium are useful.

Instead of a planar sheet, the anode and cathode of the electrochemical cell of the invention can be a hollow gas depolarized electrode. The hollow electrode is an improved form of depolarized electrode which overcomes several problems of planar depolarized electrodes, when used in electrochemical cells. The most important problem is the necessity for supporting the prior art planar electrode sheet against the gas pressure commonly applied to the backside of the electrode which is not in contact with the electrolyte.

The hollow electrode of the invention can be utilized with a gas feed without the need for support of the electrode in the electrochemical cell in view of the fact that the depolarizing gas can be fed to the hollow portion of the electrode, thus leaving the outside layer of the electrode to remain in contact with the electrolyte. In this configuration, the hydrophobic layer of the electrode is on the inner surface of the hollow electrode. Alternatively, it is contemplated that the electrolyte can circulate within the hollow area of the electrode and the gas be supplied to the external layer of the electrode. In this form of the electrode, the electrically nonconductive, porous, hydrophobic layer of the electrode is on the outside of the hollow electrode while the electrically conductive hydrophilic layer of the electrode is on the inner surface of the hollow electrode. The electrode is depolarized with a depolarizing gas fed to one side of the composite electrode while the other side of the composite layer of the electrode is in contact with electrolyte. For instance, in the electrochemical cell of the invention by feeding a gas such as air or oxygen to the hydrophobic, gas permeable side of the cathode the formation of hydrogen is avoided while the desired product, namely sodium hydroxide is formed with a decreased amount of electrical energy being required. An unsaturated hydrocarbon is fed to the hydrophobic, gas permeable side of the anode to depolarize the anode and produce a halogenated hydrocarbon.

Use of hollow electrodes in the electrochemical cell of the invention also overcomes the problem of limited current density for a hydrophobic polymer bound electrode sheet material in that such prior art composite materials are generally limited to about 1.0 ampere per square inch current density. This current density is lower than is normally desirable in an electrochemical cell such as a chlor-alkali cell utilizing a permselective membrane. The limited current density of prior art electrodes is overcome by use of the larger surface area hollow electrodes.

Gas depolarized composite electrodes having homogeneous electrochemically active and inactive layers are well known in the art. Preferably a composite hollow electrode having a heterogeneous active layer is utilized. The heterogeneous active layer of the preferred composite gas depolarized electrode can contain electrically conductive carbon. For example, acetylene black and binder can be used to form the conductive electrode layer which can be formed by precipitation of a polytetrafluoroethylene dispersion on dispersed acetylene black. The mixture of polytetrafluoroethylene and acetylene black can be formed into a block. The mixture of polytetrafluoroethylene and acetylene black can be then molded or extruded into the desired hollow shape. By an extrusion process it is possible to coextrude the electrode with two layers of different composition. Thus the electrochemically active layer can be extruded surrounding an electrochemically inactive, hydrophobic layer. The current distributor or current collector can be attached to the electrochemically active layer of the electrode subsequent to formation of the two layers forming the composite electrode of the invention.

The heterogeneous active layer of a composite gas diffusion electrode of the invention consists of the same layers and is prepared as previously described for the sheet electrode except that the electrode material is molded or extruded to form the hollow electrode as described above.

Thus the electrochemical cell of the invention can have an anode which is a gas diffusion composite hollow electrode having an electrically conductive, porous, hydrophilic, electrochemically active layer comprising conductive carbon and a polymeric binder therefor; a porous, hydrophobic layer comprising a hydrophobic polymer; and an electrically conductive current collector in contact with said hydrophilic layer. The electrochemical cell of the invention can also have a hydrophilic layer which is electrochemically active and characterized as homogeneous and electrolyte-permeable comprising a sintered mixture of a major amount of an electrically conductive, hydrophilic particulate material and a minor amount of a hydrophobic polymer binder, said particulate material being substantially coated with said hydrophobic polymer by precipitation of said hydrophobic polymer upon said particulate material.

The electrochemical cell of the invention can also have an anode and a cathode having a layer which is electrochemically active, heterogeneous and comprised of a sintered mixture of a hydrophilic, electrolyte-permeable, interconnected island material comprising a blend of a major amount of an electrically conductive, particulate material containing admixed therewith an electrochemically active catalyst and a minor amount of a hydrophobic polymer wherein said particulate material is substantially bonded with said hydrophobic polymer, and a hydrophobic matrix material consisting essentially of a hydrophobic polymer rendered substantially porous by the removal of a pore-forming ingredient. Generally, the gas diffusion electrodes of the electrochemical cell of the invention are electrodes wherein the hydrophobic polymer is present in an amount of about 20 to about 60 percent by weight.

Instead of a planar sheet or hollow gas depolarized electrodes, either the anode or the cathode of the electrochemical cell of the invention can be a packed bed electrode. In this type electrode a gas and a liquid electrolyte are brought into contact in a fluid permeable, packed bed electrode mass. A packed bed electrode, also termed a fixed bed electrode, is used in conjunction with an electrolyte permeable diaphragm. Permselective membranes are not applicable since the flow of electrolyte to the packed bed electrode is accomplished by maintaining a head of electrolyte on the side of the diaphragm opposite to that side facing the packed bed electrode. Fixed, packed bed electrodes for use in electrochemical cells for carrying out, for instance, electrolysis reactions are known in the prior art from U.S. Pat. No. 4,118,305. A packed bed electrode utilizing a downward flow of electrolyte through a fixed bed electrode material is termed a trickle bed electrode.

There are several problems relating to the use of trickle bed electrodes that tend to prevent their exploitation in commercial processes. One of these problems is the difficulty of providing a substantially uniform flow of electrolyte from the anolyte compartment of a chlor-alkali electrolysis cell through the electrolyte permeable diaphragm to the packed bed cathode over the entire range of practical electrolyte head levels. In electrolytic cells having an electrolyte head of from 1 foot to 6 feet, the unevenness of flow of anolyte through the electrolyte permeable cell diaphragm to the fixed bed cathode is readily apparent. At the lower portion of a vertical cathode which is exposed to the full height of the anolyte, flooding of a portion of fixed bed cathode can occur while at the same time at the opposite end, which is exposed to only a small fraction of the anolyte liquid head, the fixed bed cathode is subjected to an insufficient flow of anolyte and therefore there results insufficient wetting of the fixed bed cathode which causes an increase in cell voltage.

In order to avoid flooding of a fixed bed cathode, the prior art has suggested the use of special waterproofed electrodes and/or attempted to balance the anolyte pressure with the gas pressure across the fixed bed cathode. One method of controlling the flow through the cell separator is to operate the anolyte compartment under either gas or liquid pressure. In this method the anolyte chamber of the electrolytic cell is sealed from the atmosphere and gas pressure or liquid pressure is exerted upon the electrolyte. High pressure pumps can be used to force a pressurized liquid into the opposing catholyte compartment or pressurized gas can be fed to the cathode compartment. Alternatively the pressure drop across the cell diaphragm can be regulated by pulling a vacuum on the fixed bed cathode side of the cell separator. This will pull the electrolyte toward and through the separator and finally into the fixed bed cathode. These methods have not proven commercially acceptable and have led to further research effort, the results of which form the basis of this invention.

An electrochemical cell utilizing a packed bed electrode is useful in the production of halogenated hydrocarbons and alkali metal hydroxide. Where a fixed bed, gas diffusion cathode is utilized for the electrolysis of, for example, sodium chloride, chlorine produced at the anode of the cell is used to chlorinate an unsaturated hydrocarbon and aqueous sodium hydroxide is produced in the catholyte compartment of the cell. Hydrogen, which would normally be produced at the cathode, is not produced when an oxygen containing gas is fed to the cathode thus effecting a saving in cell voltage.

In the prior art, the cathodes developed for utilization of oxygen as a depolarizing gas were characterized by a structure composed of a thin sandwich of a microporous separator of plastic film combined with a catalyzed layer which is wetproofed with a fluorocarbon polymer. Such gas depolarized cathodes generally contain a wire screen current distributor for distributing current to the catalyzed layer of the electrode. An oxygen containing gas is fed into the catalyzed layer zone of the cathode through a microporous backing. Such cathodes have suffered from various deficiencies including delamination of the various layers during operation in the cell and the ultimate flooding by electrolyte of the catalyzed layer leading to inactivation of the cathode and shut down of the cell. The fixed bed electrodes described above are an improved form of gas depolarized cathode for use in the production of a halogenated hydrocarbon and an alkali metal hydroxide.

The packed bed electrodes for use in the electrolysis cell of the invention can be either anodes or cathodes but both packed bed electrodes cannot be used in the same cell. The electrodes of the cell are separated by an electrolyte permeable porous diaphragm composed of an assembly having a plurality of layers of a composite material comprising a supporting fabric resistant to degradation upon exposure to electrolyte and a microporous polyolefin film. If the electrode is a packed bed cathode, the electrochemical reaction is conducted by maintaining a head of liquid electrolyte in the anolyte compartment while a depolarizing gas is simultaneously flowed into at least a portion of the pores of the self-draining packed bed electrode. The gas is an oxygen containing gas. Alternatively, an unsaturated hydrocarbon is the depolarizing gas or liquid where the packed bed electrode is an anode. In either case, electrolyte is simultaneously flowed through the plural layered liquid electrolyte permeable diaphragm of the invention into the porous, self-draining electrode at a rate about equal to the drainage rate of said electrode. The self-draining electrode generally has a thickness of about 0.1 to about 2.0 centimeters in the direction of current flow. The electrode can be in the form of a bed of loose conductive particles or a fixed porous matrix. It is generally composed of a material which may also be a good electrocatalyst for the reaction to be carried out. Graphite particles have been found to be suitable for forming the electrode mass because graphite is cheap, conductive, and requires no special treatment. For other reactions, graphite or other forms of carbon or tungsten carbide can be used as well as certain metals such as platinum, iridium, or metal oxides such as lead dioxide or manganese dioxide coated on a conducting or nonconducting substrate. The graphite particles typically have diameters in the range of about 0.005 to about 2.0 centimeters. It is the bed of particles which acts as the electrode in the electrochemical reaction. Generally the self-draining electrode is supplied with current through a current distributor which can be a metal mesh which is held in contact with the electrode. During operation of the cell the electrode is supplied with an oxygen containing gas so as to depolarize the cathode or the anode is supplied with an unsaturated hydrocarbon so as to produce a halogenated hydrocarbon.

The electrochemical cell of the invention which can be a monopolar or bipolar cell, for instance, an electrolytic cell utilized for the production of a halogenated hydrocarbon and sodium hydroxide contains a cell separator, or diaphragm, separating an anolyte compartment and a catholyte compartment which compartments contain, respectively, the anode and cathode of the cell. Generally the cell diaphragm is vertically positioned and either indirectly or directly supported by the self-draining cathode. The current distributor is often positioned between the self-draining cathode and the cell diaphragm. The cell diaphragm comprises an assembly having a plurality of layers of a porous diaphragm material composite vertically arranged and comprising a support fabric resistant to degradation upon exposure to electrolyte and a microporous polyolefin film. Preferably multiple layers of said porous diaphragm composite are utilized. No necessity exists for holding together the multiple layers of the diaphragm at the peripheral portions thereof where the diaphragm is positioned within the electrolytic cell. Multiple diaphragm layers of from two to four layers have been found useful in reducing the variation in flow of electrolyte through the cell diaphragm over the usual and practical range of electrolyte head. Portions of such a diaphragm which are exposed to the full head of electrolyte as compared with portions of such a cell diaphragm which are exposed to little or no electrolyte head pass substantially the same amount of electrolyte to the electrode.

As an alternative means of producing a useful multiple layer vertical diaphragm, it has been found desirable to prepare a cell diaphragm having variable layers of the defined porous composite diaphragm material. Thus it is suitable to utilize one to two layers of the defined porous composite material in areas of the cell diaphragm which are exposed to relatively low pressure as the result of being positioned close to the surface of the body of electrolyte while utilizing two to six layers of the defined composite porous material in areas of the diaphragm exposed to moderate or high pressure of the electrolyte. A preferred construction is two layers of the defined composite porous material at the upper end of the diaphragm and three layers of said composite at the opposite end of said diaphragm.

The multiple layer diaphragm comprises a microporous polymer film material having laminated thereto a support fabric layer which is resistant to deterioration upon exposure to electrolyte or products of electrolysis. For use in the preparation of halogenated hydrocarbons and sodium hydroxide, a polypropylene woven or nonwoven fabric support layer has been found acceptable. Alternatively there can be used any polyolefin, polyamide, or polyester fabric or mixtures thereof and each of these materials can be used in combination with asbestos in the preparation of the supporting fabric. Representative support fabrics include fabrics composed of polyethylene, polypropylene, polytetrafluoroethylene, fluorinated ethylenepropylene, polychlorotrifluoroethylene, polyvinyl fluoride, asbestos, and polyvinylidene fluoride. A microporous polypropylene is preferred. This film resists attack by strong acids and bases. The composite is characterized as hydrophilic having been treated with a wetting gent in the preparation thereof. In a 1 mil thickness, the film portion of the composite has a porosity of about 38%, and an effective pore size of $1.6\times10^{-3}$ mil and an aqueous flow rate of 0.28 cubic inches per square inch per minute. The composite has a permeability in a single layer of said film and said support fabric of about $1.7\times10^{-10}$ to $1.6\times10^{-8}$ millimeters per minute per square centimeter. Such porous material composites are available under the trade designation CELGARD® from Celanese Corporation. Utilizing multiple layers of the above described composite porous material, it is possible to obtain a flow rate within an electrolytic cell of 0.08 to 0.10 millileters per minute per square inch of separator generally over a range of electrolyte head of 1 foot to 6 feet, preferably 1 to 4 feet.

Self-draining, packed bed cathodes are disclosed in the prior art such as in U.S. Pat. No. 4,118,305; U.S. Pat. No. 3,969,201; U.S. Pat. No. 4,445,986; and U.S. Pat. No. 4,457,953 each of which are hereby incorporated by reference. The packed bed electrode is typically composed of graphite particles, however other forms of carbon can be used as well as certain metals. The packed bed electrode has a plurality of interconnecting passageways having average diameters sufficiently large so as to make the electrodes self-draining, that is, the effects of gravity are greater than the effects of capillary pressure on an electrolyte present within the passageways. The diameter actually required depends upon the surface tension, the viscosity, and other physical characteristics of the electrolyte present within the packed bed electrode. Generally the passageways have a minimum diameter of about 30 to about 50 microns. The maximum diameter is not critical. The self-draining electrode should not be so thick as to unduly increase the resistance losses of the cell. A suitable thickness for the packed bed electrode has been found to be about 0.03 inch to about 0.25 inch, preferably about 0.06 inch to about 0.2 inch. Generally the packed bed cathode is electrically conductive and prepared from such materials as graphite, steel, iron, and nickel. Glass, various plastics, and various ceramics can be used in admixture with conductive materials. The individual particles can be supported by a screen or other suitable support or the particles can be sintered or otherwise bonded together but none of these alternatives is necessary for the satisfactory operation of the packed bed electrode.

An improved material useful in the formation of the packed bed cathode is disclosed in U.S. Pat. No. 4,457,953 comprising a particulate substrate which is at least partially coated with an admixture of a binder and an electrochemically active, electrically conductive catalyst. Typically the substrate is formed of an electrically conductive or nonconductive material having a particle size smaller than about 0.3 millimeters to 2.5 centimeters or more. The substrate need not be inert to the electrolyte or to the products of the electrolysis of the process in which the particle is used but is preferably chemically inert since the coating which is applied to the particle substrate need not totally cover the substrate particles for the purposes of rendering the particle useful as a component of a packed bed electrode. Typically the coating on the particle substrate is a mixture of a binder and an electrochemically active, electrically conductive catalyst. Various examples of binder and catalyst are disclosed in U.S. Pat. No. 4,457,953, incorporated herein by reference.

In an electrolytic cell where aqueous sodium or potassium hydroxide is desired as a product, generally the brine is fed to the anolyte compartment of the electrolytic cell at a pH of about 1.5 to about 5.5. Typically the sodium or potassium chloride is fed at a saturated or substantially saturated concentration containing from about 300 to about 325 grams per liter of sodium chloride or from about 450 to about 500 grams per liter of potassium chloride. The catholyte liquor recovered from the electrolytic cell can contain approximately 10 to 12 weight percent sodium hydroxide and 15 to 25 weight percent sodium chloride or approximately 15 to 20 weight percent potassium hydroxide and approximately 20 to 30 weight percent potassium chloride.

In an electrochemical cell for the production of halogenated hydrocarbons, typically the anolyte liquor is an aqueous solution containing about 15 to about 100 grams per liter of alkali metal halide. The catholyte liquor recovered from the cell can contain approximately 15 to 100 grams per liter sodium hydroxide.

The cell separator 36 used with the sheet form or hollow form of gas depolarized electrode can be formed of any material that is chemically inert to the electrolyte and the unsaturated hydrocarbon being halogenated. The separator can be an electrolyte-permeable membrane such as an asbestos diaphragm or an ion exchange permselective membrane, such as an anion-exchange membrane. In the construction of the cell, the adjacent surface of said anode 32 and said cathode 34 are spaced apart sufficiently for said cell separator 36 to fit freely therebetween. Anion-exchange permselective membranes are particularly suitable for the electrochemical cell of the invention.

The anion-exchange membrane can be formed of at least one layer of from about 2 to about 25 mils thickness although thicker or thinner permselective membranes may be utilized. The electrolyte permeable diaphragm or permselective membrane can be an assembly or laminate of 2 or more membrane sheets. It may additionally have an internal or external reinforcing structure. The functional group of the anion-exchange permselective membrane is an anion selective group such as a quaternary ammonium group, a secondary amine group, or a tertiary amine group. Exemplary anion selective permselective membranes include ammonium derivatives of styrene and styrene-divinyl benzene polymers, amine derivatives of styrene and styrene-divinyl benzene, condensation polymers of alkyl oxides, for instance, ethylene oxide or epichlorohydrin with amines, or ammonia, ammoniated condensation products of phenol and formaldehyde, the ammononiated products of acrylic and methacrylic esters, iminodiacetate derivatives of styrene, and styrene-divinyl benzene.

A permselective membrane for use in the electrochemical cell of the invention typically has an ion exchange capacity of from about 0.5 to about 2.0 milliequivalents per gram of dry polymer, perferably from about 0.9 to about 1.8 milliequivalents per gram of dry polymer, and in a particularly preferred exemplification, from about 1.0 to about 1.6 milliequivalents per gram of dry polymer. A useful perfluorinated permselective membrane can have, in the ester form, a volumetric flow rate of 100 cubic millimeters per second at a temperature of 150 to 300 degrees centigrade and preferably at a temperature between 160 to 250 degrees centigrade. The glass transition temperatures of such permselective membrane polymers are desirably below 70 degrees centigrade and preferably below about 50 degrees centigrade.

The permselective membrane useful in the electrochemical cell of the invention can be prepared by the methods described in U.S. Pat. No. 4,126,588, the disclosure of which is incorporated herein by reference. Most commonly, the ion exchange resins utilized in forming the permselective membrane will be, during fabrication, in a thermoplastic form, that is, a carboxylic acid ester, for instance, a carboxylic acid ester of methyl, ethyl, propyl, isopropyl, or butyl alcohol or a sulfonyl halide, for instance, sulfonyl chloride or sulfonyl fluoride and can thereafter be hydrolyzed to provide the permselective membrane.

The electrolyte utilized in compartments 16 and 18 of the electrochemical cell of the invention can be saturated aqueous solutions of alkali metal halides such as sodium chloride and potassium chloride. Separator or baffle 10 can be formed of any material that is chemically inert to the unsaturated hydrocarbon being halogenated. The cell walls 24 can be characterized as chemically inert or resistant to the unsaturated hydrocarbon or the electrolyte solution which is contacted by said cell walls. For example, the baffle 10 and the cell walls around compartment 12 can be formed from heavy metals or polyvinyl ester resins, while the cell walls around compartments 16, 18, and 22 can be formed from polytetrafluoroethylene resins, polyvinylidene fluoride resins, or titanium metal.

In carrying out the halogenation process in the electrochemical cell of the invention, the unsaturated hydrocarbons which are provided to cell compartment 12 are preferably olefins, for instance ethylene, propylene, and butylene. The difference in electrical potential across the cell electrodes 32 and 34 is controlled to provide halogen ions from the decomposition of the alkali metal halide at a rate sufficiently great so as to produce the desired halogenated hydrocarbon products. If the potential is too low, the halogenation conversion rate and current efficiencies may be poor and if the potential is too high, undesirable by products such as chlorohydrin may be formed in excessive amounts. If necessary or desirable, an inert solvent can be utilized to form a solution of the unsaturated hydrocarbon to be halogenated. The solvents selected for this use should be chemically inert under the reaction conditions of the electrochemical cell of the invention and, for example, can include methylene chloride, hexane, diethylether, and mixtures of these or other inert solvents.

The electrochemical cell of the invention is used to selectively produce halogenated hydrocarbons by first feeding the desired unsaturated hydrocarbon to compartment 12. Electrolyte is fed to compartments 16 and 18. An electrical current is then passed through the cell by connecting electrodes 32 and 34 to the positive and negative terminals respectively of a suitable direct current power source which is not shown in the figure. As the electrolysis process proceeds, the unsaturated hydrocarbon, or solution thereof in an inert solvent, diffuses through layer 30 and current collector 28 into layer 26 of anode 32. At the same time the electrolyte solution diffuses through layer 26 and contacts the unsaturated hydrocarbon at an interface which is formed within the porous layer 26. Selective electrochemical halogenation of the unsaturated hydrocarbon takes place at this interface. The interface is formed as a result of the special chemical properties of layers 26 and 30 and is carefully maintained in the embodiments of the invention shown in the figures by controlling pressures of the aqueous electrolyte solution and the unsaturated hydrocarbon in cell compartments 12 and 16 such that there is no substantial pressure differential between these two compartments. There are many well known methods of measuring and controlling liquid pressures such as pump and valve systems that can be used with the electrochemical cell of the invention. Selection of such methods is dependent upon the specific needs of the particular application involved.

Subsequent to formation of the halogenated hydrocarbon in the electrochemical cell of the invention, the halogenated hydrocarbon diffuses into compartment 16, blends with the electrolyte therein and is removed from the cell by separation from the electrolyte using known methods. The halogenated hydrocarbon can be separated from the electrolyte by conventional techniques such as fractional distillation or fractional crystalization and the remaining electrolyte is recirculated back to cell compartment 16 subsequent to the concentration of the alkali metal halide being increased to compensate for depletion which occurs during the electrolysis process. By the electrochemical process of the invention it is possible to obtain a dihalogenated olefin in high yields with a yield of monohalogenated olefin as a byproduct in very low yields such as about 5 percent.

At the cathode of the electrochemical cell, an alkali metal hydroxide is formed and removed and electrolyte can be replaced by passage across the electrolyte permeable diaphragm 36. Where a permselective membrane is utilized instead of an electrolyte permeable diaphragm, it is necessary to recirculate an alkali metal halide electrolyte solution through compartment 18 as well as remove the alkali metal hydroxide solution formed at cathode 34. As indicated above, cathode 34 can be a dimensionally stable cathode which can also be foraminous but for optimum operation of the cell, cathode 34 is preferably a gas depolarized cathode as shown in FIG. 1. Use of such a gas depolarized electrode in conjunction with the supply of an oxygen-containing gas to gas space 22 eliminates the formation of unwanted hydrogen gas at cathode 34 and permits the operation of the cell at reduced cell voltages. In operation of the cell of the invention, the oxygen containing gas permeates hydrophobic layer 30 passes through current collector screen 28 and diffuses to hydrophilic layer 26 so as to form an interface with the electrolyte which diffuses into layer 26 of electrode 34 from electrolyte space 18.

The following examples illustrate the various aspects of the invention but are not intended to limit its scope. Where not otherwise specified throughout this specification and claims, temperatures are given in degrees centigrade, and parts, percentages, and proportions are by weight.

EXAMPLE 1

A 2 inch by 2 inch chlor alkali membrane cell was constructed from acrylic plastic. A Nafion® cation exchange membrane separated the cathode and anode compartment. The cathode consisted of a 2 inch by 2 inch expanded nickel sheet to which a 0.25 inch diameter nickel rod was welded for a current collector. The catholyte cavity was 0.5 inches deep. A one liter 20 weight percent sodium hydroxide catholyte was slowly passed through the cathode chamber as the cell operated. The anode consisted of a 1.0 mg/cm$^2$ catalyst coating deposited with a fluorocarbon binder on a graphite cloth electrode. It was obtained from Prototech Company of Newton Highlands, Massachusetts. A platinum screen current collector was placed on the gas chamber side of the electrode. A 0.25 inch spacer separated the anode from the membrane. A 0.25 inch deep gas cavity was on the other side of the anode. A 300 grams per liter brine solution was slowly passed between the anode and the membrane during testing. Ethylene was passed through the gas chamber at a rate of 50 cc/minute. The cell was energized by a direct current power supply. When operated at 70° C. and 0.25 amps/inch$^2$ the cell voltage was 2.43 volts. When operated with nitrogen instead of ethylene the voltage was 2.70 volts at 0.25 amps/inch$^2$. Therefore, a ten percent voltage reduction was obtained. The exhaust gas was analyzed by gas chromatographic techniques. The liquid product was extracted from the brine effluent with carbon disulfide and was analyzed by gas chromatographic analysis. The major product was 94 weight percent 1,2 dichloroethane and the only minor product was 6 weight percent ethylene chlorohydrin.

EXAMPLE II

The cell of example I was operated with propylene instead of ethylene. The voltage reduction was approximately 0.1 volts when operated at 0.25 amps/inch$^2$. The major product was 1,2 dichloropropane with traces of propylene chlorohydrin produced.

EXAMPLE III

The cell of example I was operated with 1,4 butadiene instead of ethylene. No appreciable voltage reduction was detected when operated at 0.25 amps/inch$^2$. The only product was 1,4 dichloro-2-butene.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. A process for the production of a dihalogenated olefin and an alkali metal hydroxide wherein the free energy of the electrolysis reaction of an alkali metal halide is reduced, so as to reduce energy consumption in the production of an alkali metal hydroxide, by depolarizing a gas diffusion anode with a gaseous olefin; said process comprising providing an electrochemical cell having a porous anode comprising a gas and electrolyte diffusion layer and a cathode, separated by a permselective membrane or an electrolyte permeable diaphragm, and said anode and cathode are contained respectively in an anolyte compartment and a catholyte compartment of said electrochemical cell; said process comprising;

(A) flowing a gaseous olefin to said anolyte compartment;

(B) flowing an aqueous alkali metal halide electrolyte to said catholyte compartment;

(C) forming at least one dihalogenated olefin by reacting said gaseous olefin with a halogen; and (D) separating said dihalogenated olefin.

2. The process of claim 1 wherein said electrolyte permeable diaphragm consists of at least one layer of asbestos or at least one layer of a microporous polyolefin film and said olefin is selected from the group consisting of at least one of ethylene and propylene.

3. The process of claim 1 wherein said porous anode is an assembly which comprises a heterogeneous or homogeneous, gas diffusion anode and an electrically conductive current collector in contact therewith; said anode is a mixture comprising an electrically conductive, particulate material and a hydrophobic polymer; said cathode is a porous gas diffusion cathode; and said anode and cathode are separated by an anion permeable permselective membrane.

4. The process of claim 3 wherein said anode comprises a gas diffusion, hollow anode having an electrically conductive, porous, hydrophilic, electrochemically active layer comprising an electrically conductive carbon and a porous, homogeneous, hydrophobic layer comprising a hydrophobic polymer.

* * * * *